US009741469B2

(12) United States Patent
Janssen et al.

(10) Patent No.: US 9,741,469 B2
(45) Date of Patent: Aug. 22, 2017

(54) DATA CABLE FOR HIGH-SPEED DATA TRANSMISSIONS

(71) Applicant: LEONI KABEL GMBH, Nuremburg (DE)

(72) Inventors: Bernd Janssen, Friesoythe ot Neuscharrel (DE); Melanie Dettmer, Heede (DE)

(73) Assignee: Leoni Kabel GmbH, Nuernberg (DE)

( * ) Notice: Subject to any disclaimer, the term of this patent is extended or adjusted under 35 U.S.C. 154(b) by 0 days.

(21) Appl. No.: 15/414,885

(22) Filed: Jan. 25, 2017

(65) Prior Publication Data

US 2017/0133125 A1 May 11, 2017

Related U.S. Application Data

(63) Continuation of application No. PCT/EP2015/065034, filed on Jul. 1, 2015.

(30) Foreign Application Priority Data

Jul. 25, 2014 (DE) ..... 10 2014 214 726

(51) Int. Cl.
*H01B 11/00* (2006.01)
*H01B 13/18* (2006.01)

(52) U.S. Cl.
CPC ..... *H01B 11/002* (2013.01)

(58) Field of Classification Search
CPC ..... H01B 11/002; H01B 11/06; H01B 11/08; H01B 11/10; H01B 7/0241; H01B 7/08; H01B 7/0807; H01B 7/0823; H01B 7/083; H01B 7/0838; H01B 7/0861; H01B 13/26
See application file for complete search history.

(56) References Cited

U.S. PATENT DOCUMENTS

| | | | | |
|---|---|---|---|---|
| 8,444,430 | B2 | 5/2013 | Kappla et al. | |
| 2006/0180329 | A1* | 8/2006 | Caveney | H01B 11/04 174/28 |
| 2009/0260847 | A1 | 10/2009 | Tobben et al. | |
| 2013/0183846 | A1 | 7/2013 | Kappla et al. | |
| 2014/0124236 | A1* | 5/2014 | Vu | H01B 11/1025 174/106 R |
| 2015/0008011 | A1 | 1/2015 | Koeppendoerfer et al. | |

FOREIGN PATENT DOCUMENTS

| | | | |
|---|---|---|---|
| DE | 10315609 | A1 | 10/2004 |
| DE | 102012204554 | A1 | 9/2013 |
| EP | 2112669 | A2 | 10/2009 |
| WO | 2011089003 | A1 | 7/2011 |

* cited by examiner

*Primary Examiner* — Timothy Thompson
*Assistant Examiner* — Amol Patel
(74) *Attorney, Agent, or Firm* — Laurence A. Greenberg; Werner H. Stemer; Ralph E. Locher

(57) ABSTRACT

A data cable for high-speed data transmissions includes at least one wire pair formed of wires extending in a longitudinal direction and being surrounded by a shielding foil to form a pair shielding. A dielectric intermediate film or foil having a varying lay length is spun around the wire pair between the shielding foil and the wire pair, in order to effectively avoid a damping peak at high transmission frequencies.

19 Claims, 4 Drawing Sheets

DATA CABLE FOR HIGH-SPEED DATA TRANSMISSIONS

CROSS-REFERENCE TO RELATED APPLICATION

This is a continuation application, under 35 U.S.C. §120, of copending International Application PCT/EP2015/065034, filed Jul. 1, 2015, which designated the United States; this application also claims the priority, under 35 U.S.C. §119, of German Patent Application DE 10 2014 214 726.3, filed Jul. 25, 2014; the prior applications are herewith incorporated by reference in their entirety.

BACKGROUND OF THE INVENTION

Field of the Invention

The invention relates to a data cable for high-speed data transmissions, including at least one wire pair formed of two wires extending in a longitudinal direction and being surrounded pairwise by a shielding foil in order to form a pair shielding, and a non-conductive intermediate film being spun around the wire pair as an additional film between the shielding foil and the wire pair. Such a data cable is being offered for sale by Leoni Cables and Systems of San Jose, Calif. under the brand name "23 Paralink." Such data cables are employed, in particular, for the high-speed transmission of signals between computers, for example in computing centers.

In the field of data transmission, for example in computer networks, data cables are employed in which, typically, several data lines have been combined in a common cable jacket. In the case of high-speed data transmissions, in each instance shielded pairs of wires are used as data lines, the two wires running, in particular, parallel to one another or alternatively having been twisted together. A respective wire in that case is formed of the actual conductor, for example a solid conductor wire or even a stranded wire, which in each instance is surrounded by an insulation. The pair of wires of a respective data line is surrounded by the (pair) shielding. The data cables typically exhibit a plurality of pairs of wires shielded in such a manner, which form a line core and which are surrounded by a common outer shield and a common cable jacket. Such data cables are employed for high-speed data connections and are constructed for data rates of more than 10 Gbit/s at a transmission frequency greater than 14 GHz. The outer shield in that case is important for the electromagnetic compatibility (EMC) and also for the electromagnetic interference (EMI) with the environment. No signals are transmitted through the outer shield. The respective pair shield, in contrast, determines the symmetry and the signal properties of a respective pair of wires. In that connection, a high symmetry of the pair shield is important for an undisturbed transmission of data.

In the case of such data cables it is typically a question of so-called symmetrical data lines, in which the signal is communicated through one wire and the inverted signal is communicated through the other wire. The differential signal component between those two signals is evaluated, so that external effects that act on both signals have been eliminated.

Such data cables are frequently linked to connectors in preassembled form. In the case of applications for high-speed transmissions, the connectors are frequently constructed as so-called small-form-pluggable connectors, SFP connectors for short. In that case there are differing practical variants, for example so-called SFP+, CXP or QSFP connectors. Those connectors have special connector housings such as can be gathered from International Publication WO 2011/072869 A1, corresponding to U.S. Pat. No. 8,444,430, or from International Publication WO 2011/089003 A1, corresponding to U.S. Patent Application US 2013/018384, for example. Alternatively, a direct so-called back-plane connection without a connector is also possible.

The pair shielding of a respective pair of wires in that case is frequently formed, as can be gathered from EP 2 112 669 A2, corresponding to U.S. Patent Application US 2009/0260847, for example, as a longitudinally folded shielding foil. The shielding foil has therefore been folded around the pair of wires, running in a longitudinal direction of the cable, with the opposite outer side regions of the shielding foil overlapping in an overlapping region running in the longitudinal direction. In order to guarantee a defined seating of that longitudinally folded shielding foil, and to avoid a kinking of the same into a filler region between the two wires, a dielectric intermediate film formed of plastic, in particular a PET film, has been spun between the shielding foil and the pair of wires.

In the case of the shielding foil used for the shielding, a multilayered shielding formed of at least one conductive (metal) layer and an insulating backing layer are used. A layer of aluminum is ordinarily used as the conductive layer, and a film of PET is ordinarily used as the insulating layer. The PET film takes the form of a support on which a metallic coating has been applied for the purpose of forming the conductive layer.

In addition to the longitudinally folded shielding in the case of pairs guided in parallel, in principle there is also the possibility of wrapping or spinning such a shielding foil around the pair of wires in the form of a helix. However, at higher signal frequencies starting from approximately 15 GHz such a wrapping of the pair of wires with a shielding foil is not readily possible, by reason of resonance effects due to the type of construction. For those high frequencies, the shielding foil is therefore frequently preferentially attached as a longitudinally folded shielding foil.

German Patent Application DE 10 2012 204 554 A1, corresponding to U.S. Patent Application US 2015/0008011, discloses a signal cable for a high-frequency signal transmission, in the case of which the signal conductor takes the form of a stranded conductor with a varying length of lay. In addition, the signal cable further exhibits a shielding braiding, with individual braiding strands of the shielding braiding having been wound, in this case also, with a varying length of lay. By virtue of those measures, the transmission quality is improved.

German Patent Application DE 103 15 609 A1 discloses a data cable for a high-frequency transmission of data, in which a pair of wires is surrounded by a pair shielding taking the form of a shielding foil. In addition, an intermediate film has also been spun around the pair of wires.

U.S. Patent Application US 2014/0124236 A1 discloses a further high-speed data cable, in which a shielding foil provided in the form of a pair shielding has been spun around the pair of wires with a varying length of lay.

SUMMARY OF THE INVENTION

It is accordingly an object of the invention to provide a data cable for high-speed data transmissions, which overcomes the hereinafore-mentioned disadvantages of the heretofore-known cables of this general type and which has good transmission properties even at high transmission rates and high transmission frequencies.

With the foregoing and other objects in view there is provided, in accordance with the invention, a data cable for high-speed data transmissions, including at least one pair of wires formed of two wires extending in the longitudinal direction which, in particular, run parallel to one another and which for the purpose of forming a pair shielding are surrounded pairwise by a shielding foil. A dielectric intermediate film has been spun around the pair of wires as an additional film between the shielding foil and the pair of wires. The additional dielectric intermediate film in this case has been spun around the pair of wires with a varying length of lay.

The data cable takes as its starting-point, in particular, a data cable with a longitudinally folded shielding foil with the additional intermediate film between the wire pair and the pair shielding. Studies have shown that at very high transmission frequencies a peak-type attenuation occurs even in such data cables. That peak-type attenuation could be distinctly reduced by a variation of the length of lay of the dielectric intermediate film. It will be assumed that the peak-type attenuation is to be attributed to a reflection effect by reason of the periodic interference structure with the period of the length of lay, which has been introduced by the wrapping of the intermediate film. In each instance a part of the signal is reflected on this interference structure. By virtue of the strict periodicity, a narrowband, sharp attenuation at high frequencies is formed, due to the reflection effects at the plurality of points of interference. This results, therefore, in a high attenuation peak at high frequencies in the case of the so-called insertion loss. The term "insertion loss" in the present case is understood as the attenuation that a signal undergoes when passing through a signal path (cable length). By virtue of the periodic structure, in addition this also results in a high attenuation peak at high frequencies in the case of the so-called return loss. In this case, on the feed side of the signal, a signal peak that correlates with the absorption peak of the insertion loss is obtained at the high frequency by reason of the reflections.

In principle, there would be the possibility to shift the attenuation frequency toward higher frequencies by geometrical measures such as, for example, a shorter length of lay. In the ParaLink cables described in the introduction, this is obtained by a very steep pitch of the winding. The length of lay in this case is, in particular, approximately 3 mm, so that the peak-type insertion loss and hence also the return loss lies above 25 GHz. According to the currently applicable standards, such a peak in such lines must not occur within the frequency range up to 25 GHz. However, due to the more intense wrapping, the short length of lay results in a low processing speed in the course of the wrapping of the pair of wires, leading to higher costs.

Accordingly, in conventional data cables with the intermediate film, a comparatively large attenuation (attenuation peak) occurs by reason of the addition of all of the individual reflections at a fixed, narrow frequency. As a result, a high attenuation of the signal occurs, so that the requirements of the so-called insertion loss for high transmission frequencies are only inadequately satisfied. In contrast, by reason of the varying length of lay, an attenuation peak is no longer present at a fixed frequency, so that the requirements of the insertion loss are even satisfied at high frequencies. At the same time, as a result there is the possibility to lengthen the length of lay and hence to increase the processing speed and consequently lower the costs.

The term "length of lay" or "pitch" of the intermediate film in this connection is understood to be the spacing in the longitudinal direction of the cable that the wrapping needs for a 360° revolution around the pair of wires.

In an expedient further development in this connection, the length of lay is varied within the range of at least +/−5% and, in particular, of at least +/−10%, relative to a mean length of lay. Just this comparatively small variation has proved sufficient to avoid the undesirable attenuation peak. An upper limit of the variation is, for example, +/−40%.

The mean length of lay of the intermediate film in this case preferentially lies within the range of a few millimeters, in particular within the range from 5 mm to 15 mm. In particular, the mean length of lay in this case lies approximately between 6 mm and 8 mm. With this length of lay, a fast and reliable production of the wrapping of the intermediate film, in terms of process engineering, is made possible. A high processing speed is achieved. At the same time, the properties desired with the intermediate film can be obtained in this way, namely a defined, fixed wrapping of the pair of wires, in order to place the shielding foil attached over it in a defined uniform geometry around the pair of wires, so that no symmetrical points of interference of the shielding foil have been formed.

The particular advantage of the varying length of lay becomes clear on the basis of the following example: in the case of a length of lay of 6 mm, about 166 wrappings, and hence 166 periodic points of interference, result per meter. As a consequence of these points of interference at 15 GHz, this results in a sharp peak in the return loss, which at the base is only approximately 180 MHz wide. In the case of a variation by +/−15%, the base is widened to 4500 MHz and the maximum is distinctly reduced.

In this case the length of lay expediently varies uniformly and in particular continuously, for example sinusoidally, in the longitudinal direction. The length of lay therefore varies between a maximum value and a minimum value around the mean value. In terms of process engineering this can be achieved, for example, by a variation of the draw-off speed of the pair of wires in the course of the wrapping process and/or by a variation of the spinning speed. Expediently, in this case the length of lay in the longitudinal direction varies periodically with a period length that preferentially lies within the range of a few meters, in particular within the range from 1 m to 5 m, and preferably amounts to 2 m. The term "period length of the variation" is therefore understood to be the length in the longitudinal direction, which lies between two maximum values of the length of lay. By virtue of this periodicity, although a periodic point of interference is introduced in turn, by reason of the chosen period length for the transmission frequencies of interest in the present case, and with the typical cable lengths, this is irrelevant.

A further, in particular adhesive, outer film has expediently been spun around the pair shielding. This outer film serves, in particular, for fixing the entire structure. The outer film is, in turn, a dielectric film, in particular a PET film.

In a preferred further development, provision is made for this outer film to also exhibit a varying length of lay. The arguments and preferred embodiments adduced with regard to the intermediate film are also to be applied in like manner to this outer film. The outer film therefore preferentially exhibits identical or at least comparable lengths of lay and an identical or at least similar variation of the length of lay as the intermediate film. The outer film has expediently been spun in the opposite direction with respect to the intermediate film.

Furthermore, the intermediate film has preferentially been spun around the pair of wires with a mean length of lay that is different than a length of lay of the shielding foil. In principle, the differing attenuation effects that arise by reason of differing physical boundary conditions, on one hand of the shielding foil and on the other hand of the intermediate film, can, as a result, each be selectively reduced or avoided.

In particular, provision is made for the shielding foil to have been spun around the pair of wires with a constant length of lay.

In an expedient configuration the shielding foil is a longitudinally folded foil, that is to say, virtually a shielding foil in which the length of lay is infinite. By virtue of this measure, the attenuation effect of the shielding foil by reason of the previously described resonance effect has been reliably avoided.

The shielding foil exhibits, in principle, a multilayered structure with an insulating backing layer, which is also designated as a backing film, and with a conductive layer attached thereto. The backing layer is, in particular, a dielectric plastic film, in particular a PET film. In the case of the conductive layer attached thereto, it is, in particular, a layer of aluminum which, for example, has been applied onto the backing film by vapor deposition.

Ordinarily, the entire data cable further includes a cable jacket which has been disposed around the at least one pair of wires. The data cable typically exhibits several pairs of wires provided with a pair shielding, the pairs of wires ordinarily running, stranded together, within the common cable jacket. In addition, an outer shielding has typically been disposed around the entire composite of the individual pairs of wires. In this case, for example, it is a shielding braiding and/or a multilayered shielding structure. This outer shielding has been galvanically separated with respect to the individual pair shields. This is obtained, in particular, through the aforementioned outer film of each pair, or even by a common insulating film which surrounds the stranded composite of the pairs of wires.

Other features which are considered as characteristic for the invention are set forth in the appended claims.

Although the invention is illustrated and described herein as embodied in a data cable for high-speed data transmissions, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
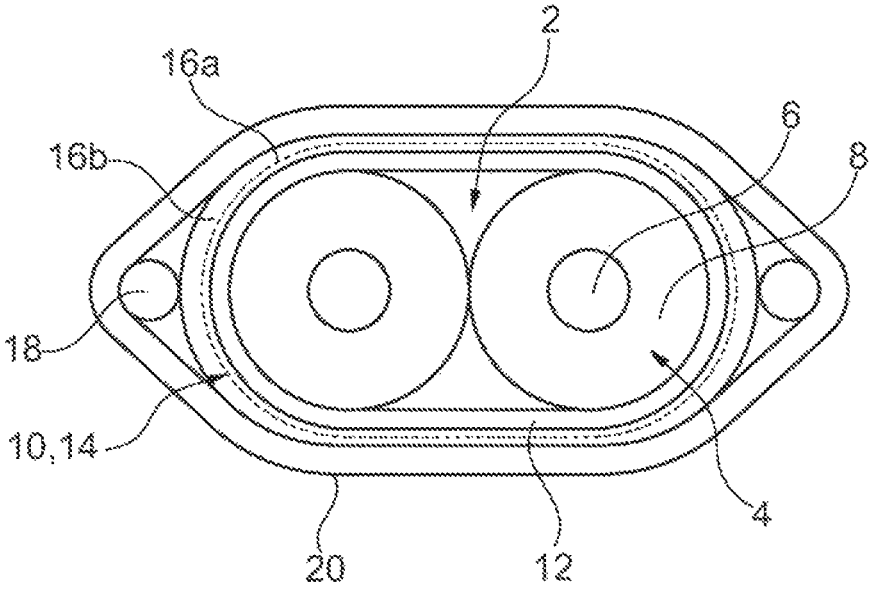
FIG. 1 is a diagrammatic, cross-sectional view of a pair of wires, surrounded by a pair shielding, of a data cable.
Figure 2:
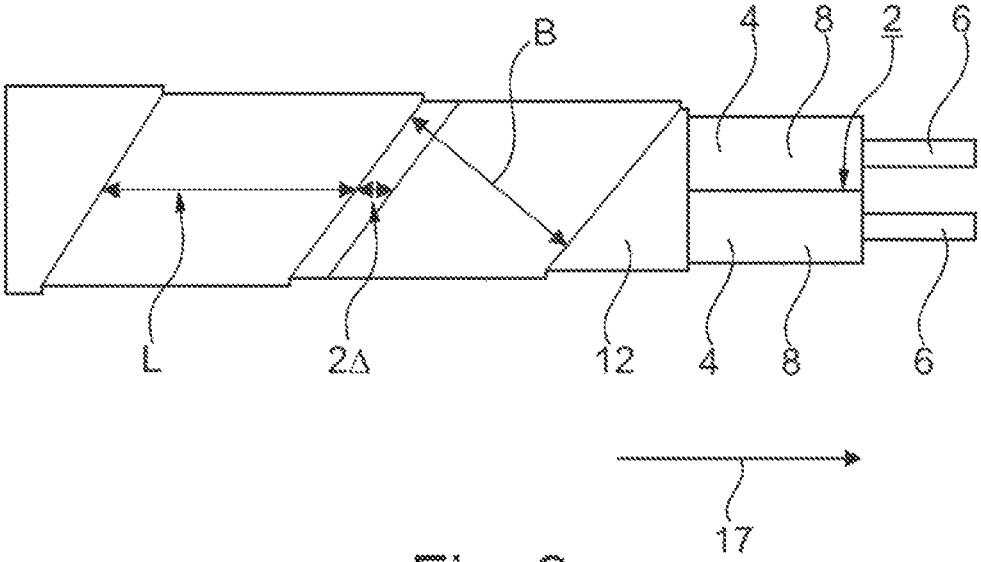
FIG. 2 is a side-elevational view showing the pair of wires, wrapped with an intermediate film, according to FIG. 1.
Figure 3:
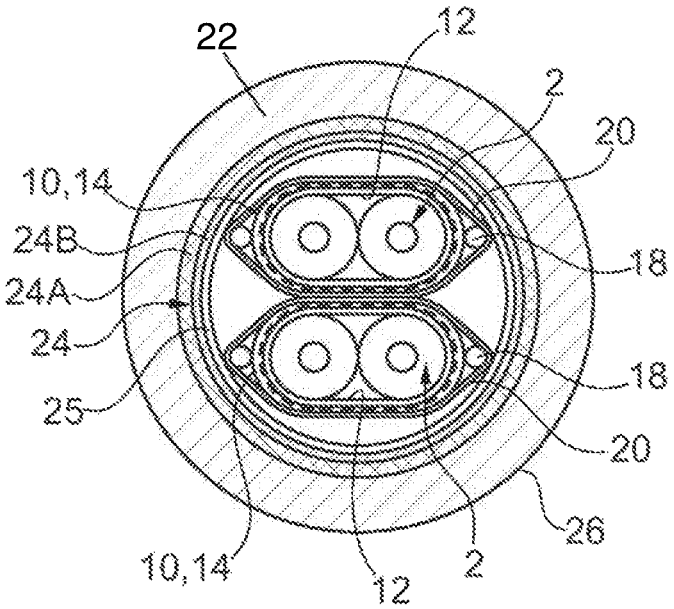
FIG. 3 is a cross-sectional view of a data cable with two shielded pairs of wires.

Referring now to the figures of the drawings in detail and first, particularly, to FIGS. 1-3 thereof, there is seen at least one wire pair 2, formed of two wires 4, in which each wire 4 in turn exhibits a central conductor 6 which is surrounded by a wire insulation 8. The wire pair 2 is surrounded in each instance by a pair shielding 10 which surrounds the wire pair 2, with the insertion or interposition of an intermediate film 12.

In the embodiment variant according to FIG. 1, the pair shielding 10 has been formed by a single multilayered shielding foil 14 which is formed of a backing layer 16*a* taking the form of a PET backing film and also an aluminum coating, attached thereto, by way of a conductive layer 16*b*. The conductive layer 16*b* is oriented outward. In the case of the shielding foil 14, a longitudinally folded shielding foil 14 is used having longitudinal edges which therefore run parallel to the wires 4 in a longitudinal direction 17. The wires 4 run in the longitudinal direction 17, untwisted and parallel to one another.

Furthermore, the entire pair structure has been wrapped by an adhesive outer film 20, with the aid of which the entire structure is fixed. This outer film 20 is, in turn, a plastic film.

Drain wires 18, which are in electrical contact with the conductive layer 16*b*, have furthermore been disposed between the pair shielding 10 and the outer film 20. The drain wires 18 serve for simplified connection of the pair shielding 10 in a connector region. The drain wires 18 lie on a common line of centers which also passes through the center axes of the wires 4. They are situated, in particular, outside the intermediate film 12 and hence also outside filler regions between the wires 4. By virtue of the bilateral opposing configuration, a highly symmetrical structure has been obtained. In principle, alternative configurations with no drain wire or with only one drain wire are possible.

All of the foils/films exhibit a thickness ordinarily within the range of merely a few pm. Insofar as it is a question of spun films, as is the case, in particular, with the intermediate film 12 and also the outer film 20, these typically exhibit a width B within a range from 4 mm to 6 mm.

Whereas in the case of the shielding foil 14 it is preferentially a longitudinally folded foil, the intermediate film 12 has been wound around the wire pair 2. This can be gathered, in particular, from the side view according to FIG. 2. The intermediate film 12 has been wound around the wire pair 2 in this case with a mean length of lay $I_m$. The length of lay I and hence the pitch of the intermediate film 12 varies in this case by a difference Δ around the mean length of lay I.

In FIG. 2 the representation of the pair shielding 10 has been dispensed with for a better overall view, and merely the intermediate film 12 can still be discerned.

A data cable 22, as represented in an exemplary manner in FIG. 3, typically exhibits one or more wire pairs 2, each provided with a pair shielding 10. Each pair element preferably exhibits a structure such as has been described with reference to FIGS. 1 and 2. The individual wire pairs 2, which are surrounded by the pair shielding 10, form a transmission core which subsequently is also surrounded by an outer shielding 24 which is galvanically separated from the pair shielding 10. In this embodiment, the outer shielding 24 is a multilayered structure which, in this case, has an exterior braiding shield 24A and an interior overall shielding foil 24B which preferably has been formed like the shielding foil 14. The outer shielding 24 may also have been formed in one layer. A further insulating film 25 has been spun between the outer shielding and the transmission core in this embodiment. Finally, a cable jacket 26 has been disposed around the outer shielding 24, by way of an outer protective sheath of the data cable 22. In this case it is typically an extruded cable jacket 26.

Figure 4:
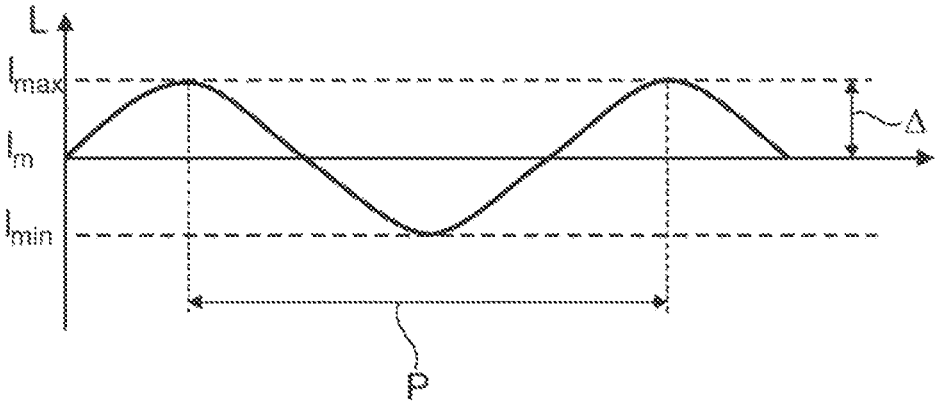
FIG. 4 is a diagram showing a variation of a length of a lay of an intermediate film.

In FIG. 4 an exemplary curve of the variation of the mean length of lay I of the intermediate film 12 is represented. As can be discerned, the length of lay L varies around the mean length of lay $I_m$ by the difference Δ between a maximum length of lay $I_{max}$ and a minimum length of lay $I_{min}$. In this case the variation occurs uniformly and periodically and, in particular, in accordance with a sine curve represented in an exemplary manner in FIG. 4. This curve therefore exhibits a periodicity with a period length P which typically lies within the range of a few meters.

In the following, the effect of the variation of the length of lay L in the case of the intermediate film 12 will be elucidated with reference to FIGS. 5A and 5B and also 6A and 6B. The diagrams represented show, schematically in each instance, measurement curves in which the attenuation a in decibels dB has been plotted over the frequency fin gigahertz GHz. The measurement curves were implemented in the case of data cables 22 having a fundamental structure according to FIG. 1 for the pair-shielded wire pair 2. In the case of the measurement according to FIGS. 5A and 6A, the basis was a conventional structure with an intermediate film 12 having a constant length of lay L, and in the case of the measurement curves of FIGS. 5B and 6B the basis was a structure having a varying length of lay L of the intermediate film 12. The measurements were made with a mean length of lay $I_m$ of the intermediate film 12 of approximately 6 mm. The length of lay L therefore lies distinctly above the conventionally chosen length of lay of, typically, approximately 3 mm, which is required, if no varying length of lay has been set, in order to shift the attenuation peak toward sufficiently high frequencies above 25 GHz.

Figure 5A:
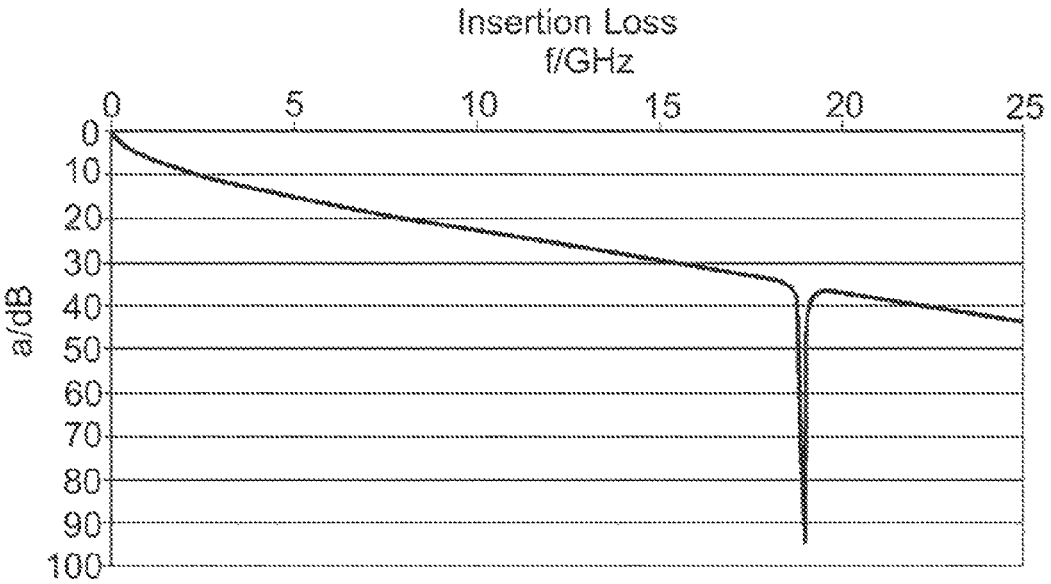
FIG. 5A is a diagram showing an insertion loss in the case of a conventionally shielded pair of wires.
Figure 5B:
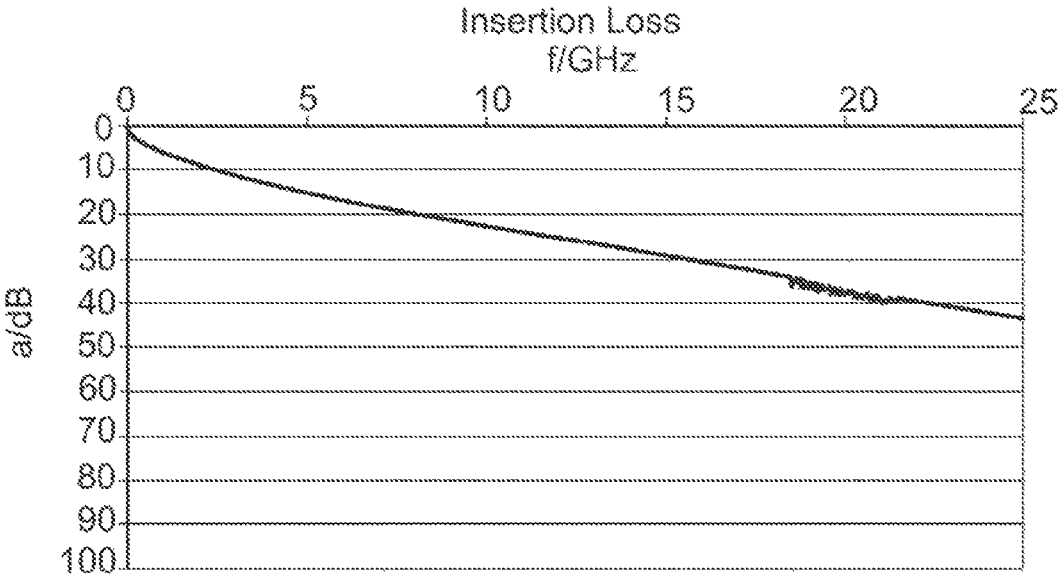
FIG. 5B is a diagram showing the insertion loss in the case of a pair of wires that has been provided with an intermediate film wound with a varying length of lay.
Figure 6A:
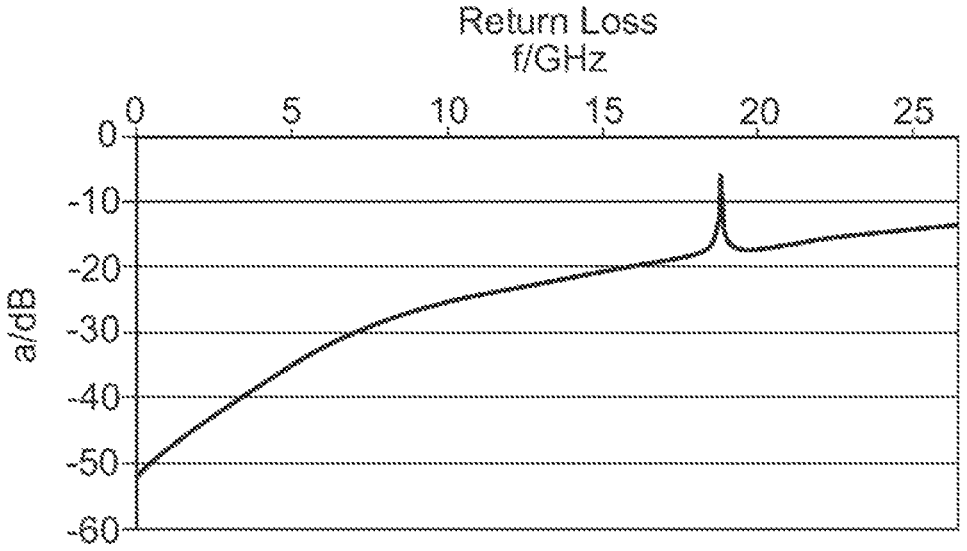
FIG. 6A is a diagram, correlated with FIG. 5A, showing a return loss in the case of the conventionally shielded pair of wires.
Figure 6B:
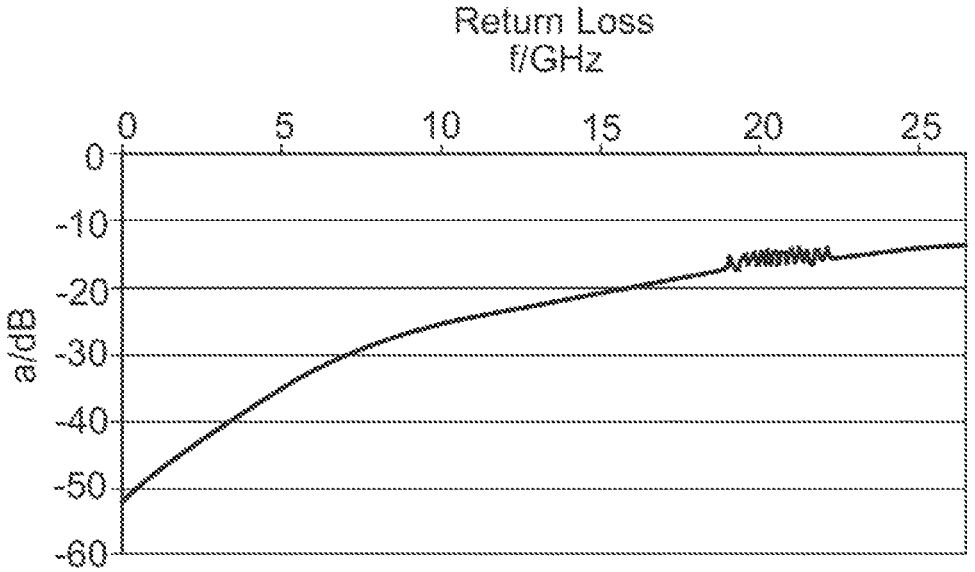
FIG. 6B is a diagram, correlated with FIG. 5B, showing the return loss in the case of the pair of wires that has been provided with an intermediate film wound with a varying length of lay.

The pair of diagrams of FIGS. 5A and 5B shows the curve of the insertion loss [in dB] in a comparison of the two cable variants, and the diagram pair of FIGS. 6A and 6B shows the curve of the return loss [in dB] in a comparison of the two cable variants, in each instance plotted against the frequency.

As can be readily discerned, the insertion loss generally increases continuously with increasing frequency. At approximately 19 GHz the data cable 22 in the variant with the constant length of lay displays a very strong attenuation peak which, in the example shown therein, displays an excursion of over 50 dB. Correspondingly, the return loss displays a similar curve and a reflection peak likewise at approximately 19 GHz. The height of the peak depends on the absolute attenuation and on the length of the line.

In contrast, in the case of the data cable 22 with the intermediate film 12 having the varying length of lay L neither a peak in the insertion loss nor a peak in the return loss exists within the corresponding frequency range. By virtue of the varying length of lay, the base of the peak is accordingly distinctly widened to a width of, preferentially, several GHz, in particular from 3 GHz to 6 GHz, for example. Correspondingly, the height of the peak is also distinctly reduced, and merely a wavy curve in the manner of a noise is evident over the width. The signal level of this noise amounts to only a fraction of the original peak height, for example less than 10% of the original peak height.

The invention claimed is:

1. A data cable for high-speed data transmissions, the data cable comprising:

at least one wire pair, each wire pair being formed of two wires extending in a longitudinal direction;

at least one shielding foil, each shielding foil surrounding a respective wire pair to form a pair shielding; and at least one dielectric intermediate film, each dielectric intermediate film being spun around a respective wire pair as an additional film between said shielding foil and said wire pair, said dielectric intermediate film being spun around said wire pair with a varying length of lay.

2. The data cable according to claim 1, wherein said length of lay varies at least within a range of +/−5% relative to a mean length of lay.

3. The data cable according to claim 1, wherein said length of lay varies at least within a range of at least up to +/−10% relative to a mean length of lay.

4. The data cable according to claim 1, wherein said intermediate film has a mean length of lay lying within a range of a few millimeters.

5. The data cable according to claim 1, wherein said intermediate film has a mean length of lay lying within a range of from 5 mm to 15 mm.

6. The data cable according to claim 1, wherein said intermediate film has a mean length of lay amounting in particular standards to approximately 6 mm to 8 mm.

7. The data cable according to claim 1, wherein said length of lay varies uniformly in said longitudinal direction.

8. The data cable according to claim 1, wherein said length of lay varies periodically in said longitudinal direction with a period length lying within a range of a few meters.

9. The data cable according to claim 1, wherein said length of lay varies periodically in said longitudinal direction with a period length lying within a range of from 1 m to 5 m.

10. The data cable according to claim 1, wherein said length of lay varies periodically in said longitudinal direction with a period length of 2 m.

11. The data cable according to claim 1, which further comprises a further outer film spun around said pair shielding.

12. The data cable according to claim 11, wherein said further outer film has a varying length of lay.

13. The data cable according to claim 1, wherein said further outer film is an adhesive.

14. The data cable according to claim 1, wherein said at least one dielectric intermediate film is spun around said at least one wire pair with a length of lay being different than a length of lay of said at least one shielding foil.

15. The data cable according to claim 1, wherein said at least one shielding foil and said at least one dielectric intermediate film are spun around said at least one wire pair with opposite-sense lays.

16. The data cable according to claim 1, wherein said at least one shielding foil is spun around said at least one wire pair with a constant length of lay.

17. The data cable according to claim 1, wherein said at least one shielding foil is at least one longitudinally folded foil.

18. The data cable according to claim 1, wherein said at least one shielding foil has a multilayered structure with an insulating backing layer and a conductive layer attached to said insulating backing layer.

19. The data cable according to claim 1, wherein a course of a feed of a high-frequency data signal within a GHz range, at least within a frequency band up to 25 GHz, causes no signal peak to occur either in an insertion loss or in a return loss.

* * * * *